US010809657B2

(12) United States Patent
Han

(10) Patent No.: US 10,809,657 B2
(45) Date of Patent: Oct. 20, 2020

(54) IMAGE FORMING APPARATUS EXECUTING CLEANING SEQUENCE OF PHOTOSENSITIVE BODY

(71) Applicant: Oki Data Corporation, Tokyo (JP)

(72) Inventor: Bing Han, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/684,058

(22) Filed: Nov. 14, 2019

(65) Prior Publication Data

US 2020/0249617 A1 Aug. 6, 2020

(30) Foreign Application Priority Data

Jan. 31, 2019 (JP) ..... 2019-015368

(51) Int. Cl.
*G03G 21/00* (2006.01)
*G03G 15/00* (2006.01)
*G03G 21/06* (2006.01)

(52) U.S. Cl.
CPC ..... *G03G 21/0005* (2013.01); *G03G 15/5033* (2013.01); *G03G 21/06* (2013.01)

(58) Field of Classification Search
CPC ..... G03G 21/0005; G03G 21/06; G03G 15/5033; G03G 15/5037; G03G 2221/0073
See application file for complete search history.

(56) References Cited

U.S. PATENT DOCUMENTS

2013/0136499 A1* 5/2013 Kamiyama ..... G03G 21/0005 399/128
2018/0246462 A1* 8/2018 Iriyama ..... G03G 21/06
2019/0278201 A1* 9/2019 Watanabe ..... G03G 21/0005

FOREIGN PATENT DOCUMENTS

JP 2005-208223 A 8/2005

* cited by examiner

*Primary Examiner* — Sophia S Chen
(74) *Attorney, Agent, or Firm* — Muncy, Geissler, Olds & Lowe, P.C.

(57) ABSTRACT

An image forming apparatus includes an image forming unit composed with a photosensitive body, a cleaning part, a charging part, and a development part, an exposure part, a control part, a sensor, a voltage application part and an exposure control part. Wherein in a state where the exposure part is suspended in order not to form an electrostatic latent image, the control part applies a charging voltage, a development voltage, and a transfer voltage, and afterwards executes a light exposure detection process using the sensor, and if a developer image of threshold, which indicates that a light exposure occurred, is detected, the control part executes a cleaning sequence of the photosensitive body using the cleaning part.

16 Claims, 10 Drawing Sheets

Continued to Fig. 8B

IMAGE FORMING APPARATUS EXECUTING CLEANING SEQUENCE OF PHOTOSENSITIVE BODY

TECHNICAL FIELD

This invention relates to an image forming apparatus provided with a photosensitive drum, and especially relates to a process when the photosensitive drum is exposed to light.

Conventionally, there was one having a configuration that an afterimage in the normal print operation was eliminated by irradiating the photosensitive drum with destaticizing light using an LED light source or a laser light source after a transfer process (e.g., see Patent Document 1).

RELATED ART

[Patent Doc.] JP Laid-Open Patent Application Publication 2005-208223, see pages 5-6 and FIG. 2.

However, there was no consideration on a case where the photosensitive drum was exposed with external light, and no measure or treatment was taken against its influence on the print quality.

SUMMARY

An image forming apparatus that can perform printing by an electrophotographic method, disclosed in the application, includes an image forming unit that is composed with a photosensitive body that is rotatable and has a surface to be charged, a cleaning part that reduces potential differences on the surface of the photosensitive body due to a residual charge generated by a light exposure wherein the light exposure means to expose the surface of the photosensitive body to light, a charging part that charges the surface of the photosensitive body by applying a charging voltage, and a development part to which a development voltage is applied, and that carries a charged developer while the development part rotates, is arranged to oppose the surface of the photosensitive body, and is configured to form a developer image by moving the charged developer to the surface of the photosensitive body in correspondence with the potential differences on the surface of the photosensitive body due to the light exposure, and an exposure part that exposes the charged surface of the photosensitive body with light to form an electrostatic latent image having the potential differences, a control part, a sensor that executes a light exposure detection process to detect the developer image transferred onto a transfer-target member and sends detection information of the developer image, which is derived from a result of the light exposure detection process, to the control part, a voltage application part that is controlled by the control part to apply the charging voltage, the development voltage, and a transfer voltage for transferring the developer image, and an exposure control part that is controlled by the control part and controls the exposure part, wherein in a state where the exposure part is suspended in order not to form the electrostatic latent image, the control part applies the charging voltage, the development voltage, and the transfer voltage, and afterwards executes the light exposure detection process using the sensor, and if a developer image of threshold, which indicates that a light exposure occurred, is detected, the control part executes a cleaning sequence of the photosensitive body using the cleaning part.

According to this invention, if the photosensitive drum is influenced by light exposure of external light, a cleaning sequence is executed for reducing its influence, therefore the possibility that the print quality declines by the light exposure can be reduced.

BRIEF DESCRIPTIONS OF THE DRAWINGS

FIG. 7A shows an example of being transferred onto the recording sheet at the second time, and FIG. 7B shows an example of being transferred onto the recording sheet at the first time.

DETAILED DESCRIPTION OF THE PREFERRED EMBODIMENTS

Embodiment 1

Figure 1:
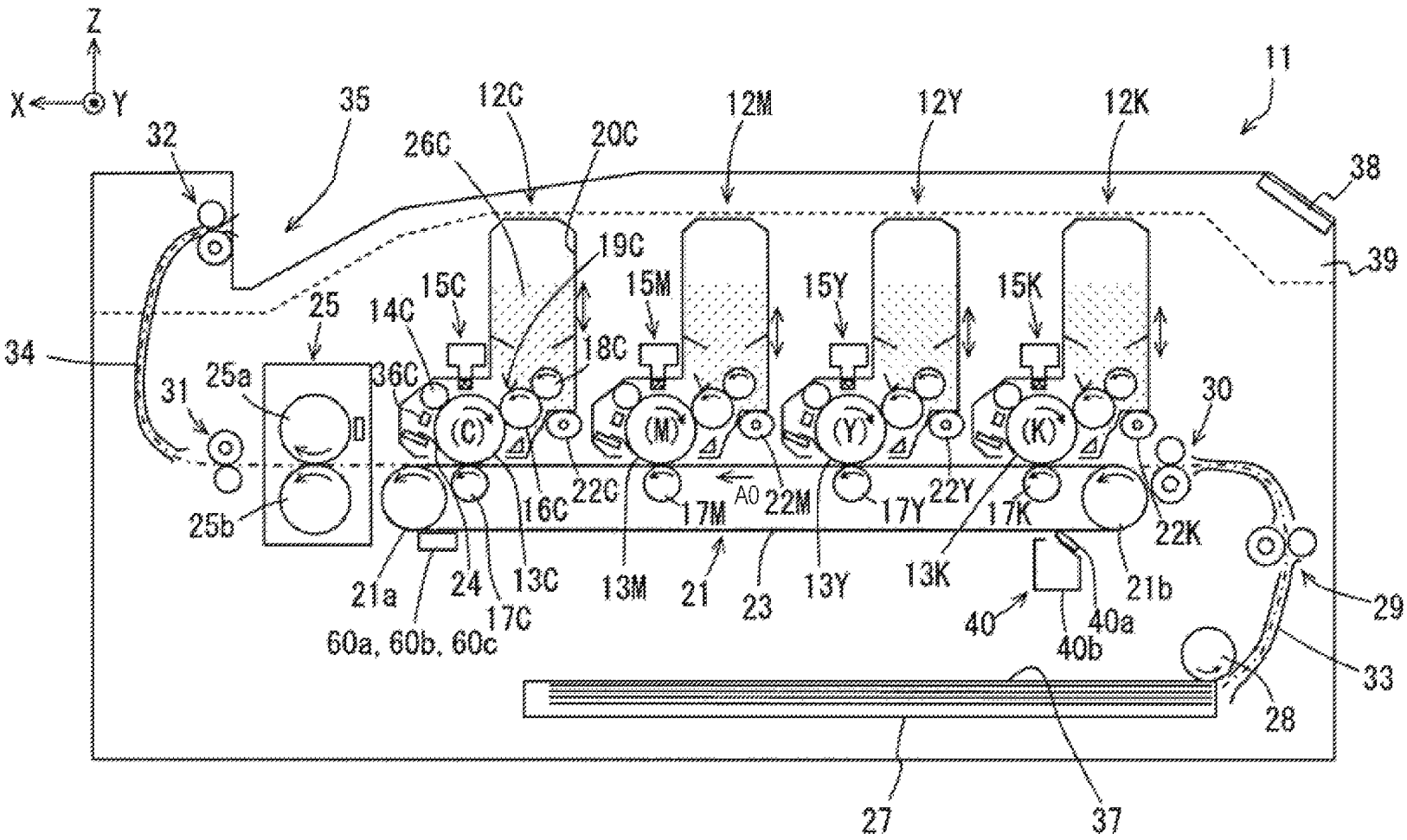
FIG. 1 is a main part configuration diagram showing the main part configuration of an image forming apparatus of Embodiment 1 by this invention.

FIG. 1 is a main part configuration diagram showing the main part configuration of an image forming apparatus 11 of Embodiment 1 by this invention.

The image forming apparatus 11 is provided with a configuration as an electrophotographic color printer of a direct transfer system for example, where four independent image forming units 12K, 12Y, 12M, and 12C (that may be simply called image forming units 12 if no special distinction is necessary) are arranged in a freely detachable manner sequentially from the upstream side along the carrying direction of a recording sheet 37 (the direction of an arrow A0). The image forming unit 12K forms a black (K) image, the image forming unit 12Y forms a yellow (Y) image, the image forming unit 12M forms a magenta (M) image, and the image forming unit 12C forms a cyan (C) image.

In this embodiment, the configurations of these image forming units 12K, 12Y, 12M, and 12C are identical, and only the colors of nonmagnetic single-component toners accommodated are different. Therefore, the cyan (C) image forming unit 12C is taken as an example here, and its internal structure is explained below.

Disposed in the image forming unit 12C are a photosensitive drum 13C (that may be simply called photosensitive drum 13 if no special distinction is necessary) as a rotatable photosensitive body, a charging roller 14C (that may be simply called charging roller 14 if no special distinction is necessary) as a charging part to charge uniformly the surface of the photosensitive drum 13C, a development roller 16C (that may be simply called development roller 16 if no special distinction is necessary) as a development part to form a toner image by having a cyan toner 26C (that may be simply called toner 26 if no special distinction is necessary) adhere to an electrostatic latent image formed on the surface of the photosensitive drum 13C, and a supply roller 18C (that may be simply called supply roller 18 if no special distinction is necessary) pressed against the development roller 16C.

The supply roller 18C is a roller that supplies the cyan toner 26C accommodated in a toner accommodation part 20C (that may be simply called toner accommodation part 20 if no special distinction is necessary) to the corresponding development roller 16C. Pressed against the development roller 16C is a development blade 19C (that may be simply called development blade 19 if no special distinction is necessary). The development blade 19C converts the toner 26C supplied from the supply roller 18C into a thin layer on the development roller 16C.

A blade 24C (that may be simply called blade 24 if no special distinction is necessary) is disposed pressed against the surface of the photosensitive drum 13C and scrapes off the toner 26C (residual toner) remaining on the photosensitive drum 13C after a transfer mentioned below. By a prescribed constant voltage being applied from a destaticizing control part 52, a destaticizing device 36C (that may be simply called destaticizing device 36 if no special distinction is necessary) irradiates the surface of the photosensitive drum 13C with destaticizing light after the transfer is finished to remove a charge and reduce potential differences. Thereby, variation in the surface potential of the photosensitive drum 13C is eliminated to prepare for charging performed subsequently by the charging roller 14C. Note that the charging roller 14 and the destaticizing device 36 correspond to a cleaning part. The cleaning part is desired to eliminate the residual charge.

In the positive direction of below-mentioned Z axis of the photosensitive drum 13C, an exposure head 15C (that may be simply called exposure head 15 if no special distinction is necessary) is arranged in a position opposing the photosensitive drum 13C. The other photosensitive drums 13K, 13Y, and 13M also have corresponding exposure heads 15K, 15Y, and 15M disposed in the same manner, respectively. The exposure head 15 selectively exposes the photosensitive drum 13 according to image data of the corresponding color and forms an electrostatic latent image on its surface.

Arranged below the photosensitive drums 13 of the four image forming units 12 is a transfer unit 21. The transfer unit 21 is provided with transfer rollers 17K, 17Y, 17M, and 17C (that may be simply called transfer rollers 17 if no special distinction is necessary) as a transfer part, and a transfer belt 23 as a transfer-target member arranged travelable in the arrow A0 direction in FIG. 1 in a stretched state by a transfer belt drive roller 21*a* and a transfer belt driven roller 21*b*.

The transfer rollers 17 are each disposed pressed against the corresponding photosensitive drums 13 through the transfer belt 23, charge the recording sheet 37 carried by the transfer belt 23 with the opposite polarity to that of the toner 26 in a nip part formed by the press contact, and transfer the respective color toner images formed on the corresponding photosensitive drums 13 sequentially superimposed onto the recording sheet 37.

Disposed on the bottom part of the four image forming units 12 in positions opposing them in the main body side of the image forming apparatus 11 are cams 22K, 22Y, 22M, and 22C (that may be simply called cams 22 if no special distinction is necessary). These cams 22 are rotationally driven individually by a cam drive part 55 (FIG. 2) to slide-move their corresponding image forming units 12 in the arrow direction along the Z axis, and position them individually to either an operation position where the photosensitive drum 13 is in contact with the transfer belt 23 or a standby position where the photosensitive drum 13 is separated from the transfer belt 23.

Arranged under the transfer unit 21 of the image forming apparatus 11 is a sheet feeding mechanism for supplying the recording sheet 37 as a recording medium to the transfer belt 23. The sheet feeding mechanism comprises a sheet feeding tray 27 that stores the recording sheets 37, a hopping roller 28 that extracts the recording sheet 37 from the sheet feeding tray 27, a sheet guide part 33 that guides the extracted recording sheet 37, registration roller pairs 29 and 30 that carry the guided recording sheet 37 to the transfer belt 23, etc.

Disposed in the vicinity of the transfer belt drive roller 21*a* along the outer side of the transfer belt 23 are density sensors 60 (or color shift/density sensor) as sensors to detect a band-shaped toner image due to light exposure transferred to the transfer belt 23. Note that these density sensors 60 and the band-shaped toner image detected by the density sensors 60 are explained in detail below. Density sensors 60 are configured to sense densities of toner, may be configured to sense the densities and color shift as well.

Disposed in the vicinity of the transfer belt driven roller 21*b* along the outer side of the transfer belt 23 is a residual toner removal device 40. This residual toner removal device 40 is provided with a belt blade 40*a* that is pressed against the outer side face of the transfer belt 23 and scrapes off the residual toner 26 adhering to this outer side face, and a toner case 40*b* that holds this belt blade 40*a* and accommodates the scraped-off toner 26.

Installed in the side where the recording sheet 37 is ejected by the transfer belt 23 is a fuser 25. The fuser 25 has a heat application roller 25*a* and a pressure application roller 25*b*, and fuses the toner transferred onto the recording sheet 37 by applying heat and a pressure. Installed in the ejection side of this fuser 25 are a carrying roller pair 31, a sheet guide part 34, an ejection roller pair 32 disposed in the rear end part of this sheet guide part 34, a sheet stacker part 35, etc. Note that the printable medium width in the main scan direction of the image forming apparatus 11 is regarded here as 297 mm (corresponding to the long-side size of the A4 sheet) allowing a landscape printing of an A4-size medium.

The image forming apparatus 11 has a top cover 39 that is rotatable centering on a rotation shaft (not shown) extending in the rotation axis direction of the photosensitive drum 13, and this top cover 39 can be opened to view the interior of the apparatus. Also, installed on this top cover 39 is a touch panel 38 as a panel that is provided with a display part and a data input part that are unshown, and is equipped with a display function by the display part and a data input function by the data input part.

Note that X, Y, and Z axes in FIG. 1 are defined by denoting the carrying direction when the recording sheet 37 passes through the image forming units 12K, 12Y, 12M, and 12C as the X axis, the rotation axis direction of the photosensitive drums 13K, 13Y, 13M, and 13C as the Y axis, and the direction perpendicular to these axes as the Z axis. Also, when the X, Y, and Z axes are shown in other figures mentioned below, their axis directions indicate common directions. That is, the X, Y, and Z axes in each figure indicate the disposition orientation of the part drawn in each figure in constituting the image forming apparatus 11 shown in FIG. 1. Also, they are disposed here so that the Z axis becomes approximately in the vertical direction.

Figure 2:
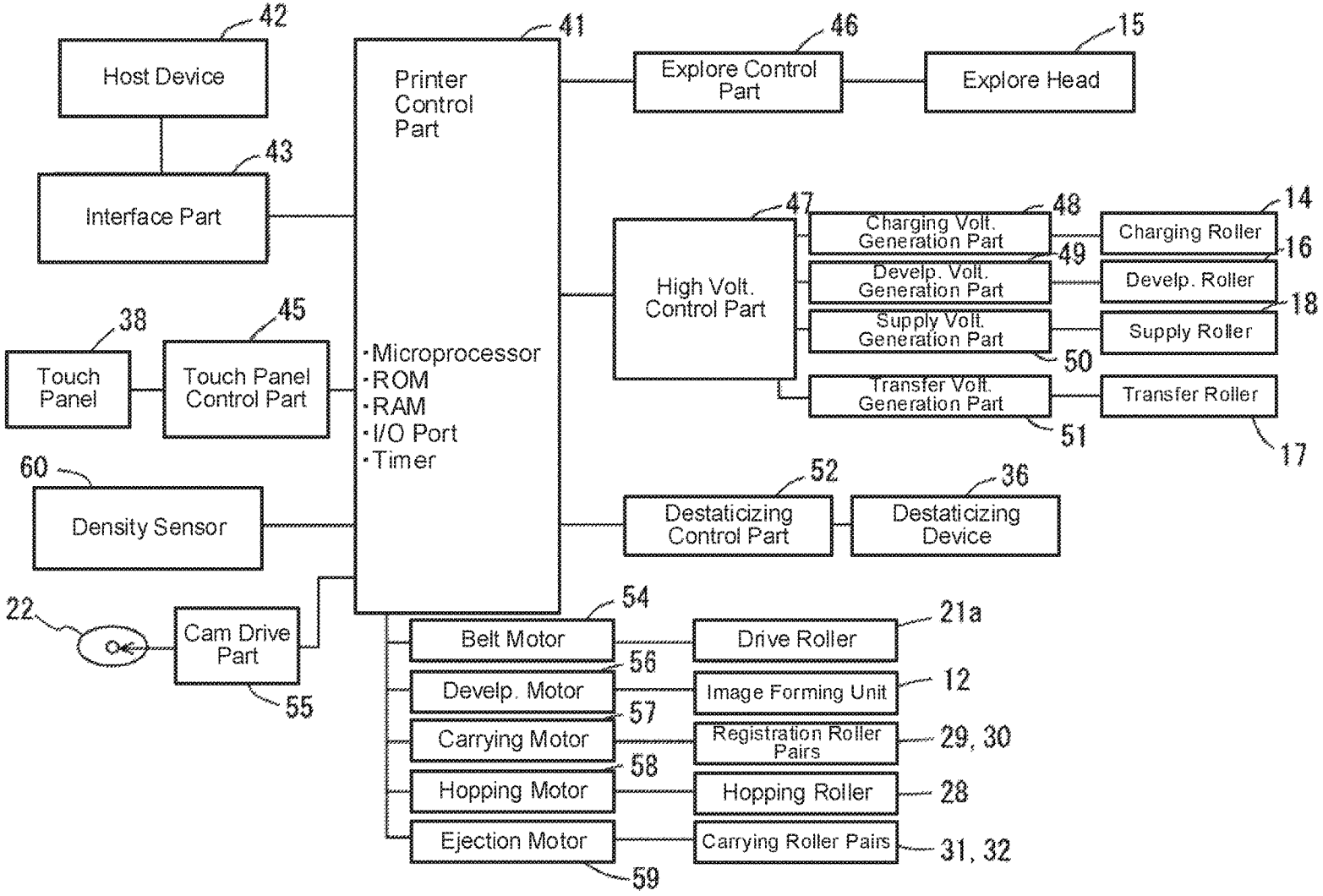
FIG. 2 is a block diagram showing the main part configuration of the control system of the image forming apparatus, related to one embodiment of this invention.

FIG. 2 is a block diagram showing the main part configuration of the control system of the image forming apparatus 11, mainly related to this invention.

In this same figure, a printer control part 41 as a control part is configured of a microprocessor, ROM, RAM, an input/output port, a timer, etc., and performs sequence control over the whole image forming apparatus 11 by receiving print data and control commands from a host device 42 to perform a print operation and a light exposure coping process mentioned below. An interface part 43 sends printer information to the host device 42, analyzes commands inputted from the host device 42, processes data received from the host device 42, and sends the result to the printer control part 41.

An exposure control part 46 as an exposure control part performs control for forming electrostatic latent images by having exposure heads 15 (K), (Y), (M), and (C) (see FIG. 1) radiate light based on the print data onto the surfaces of the charged photosensitive drums (FIG. 1) opposing them, respectively.

A belt motor 54 rotationally drives the transfer belt drive roller 21*a* in the arrow direction (FIG. 1) according an instruction of the printer control part 41. A development motor 56 rotationally drives individual rollers inside the image forming unit 12. That is, according to instructions of the printer control part 41, it rotationally drives the photosensitive drum 13, further rotationally drives the charging roller 14, the development roller 16, and the supply roller 18 via an unshown drive transmission part that is arranged between this photosensitive drum 13 and each of them and transmits the rotation of the photosensitive drum 13 to these individual parts, and as shown in FIG. 1, rotates the photosensitive drum 13 at a prescribed speed in the arrow direction and the individual rollers at prescribed speeds in the arrow directions shown in the same figure.

A carrying motor 57 rotationally drives the registration roller pairs 29 and 30 according to instructions of the printer control part 41, a hopping motor 58 rotationally drives the hopping roller 28 according to an instruction of the printer control part 41, and an ejection motor 59 rotationally drives the carrying roller pair 31 and the ejection roller pair 32 according to instructions of the printer control part 41.

The cam drive part 55 is provided with four drive motors that rotationally drive the four cams 22 individually, and rotationally drives the cams 22 (see FIG. 1) according to instructions of the printer control part 41 to move the four image forming units 12 individually to either the operation position where the photosensitive drum 13 is in contact with the transfer belt 23 or the standby position where the photosensitive drum 13 is separated from the transfer belt 23. Note that the cam drive part 55 and the cams 22 correspond to a separation part.

According to instructions of the printer control part 41, a high-voltage control part 47 applies a charging voltage (e.g., −1100 V (direct current)) to the charging roller 14 by controlling a charging voltage generation part 48, applies a development voltage (e.g., −200 V (direct current)) to the development roller 16 by similarly controlling a development voltage generation part 49, applies a supply voltage (e.g., −300 V (direction current)) to the supply roller 18 and the development blade 19 by similarly controlling a supply voltage generation part 50, and applies a prescribed transfer voltage (e.g., +2000 V~+3300 V (direct current)) to the transfer roller 17 by similarly controlling a transfer voltage generation part 51. Note that the high-voltage control part 47, the charging voltage generation part 48, the development voltage generation part 49, and the transfer voltage generation part 51 correspond to a voltage application part.

The destaticizing control part 52 applies a constant voltage (e.g., +24 V (direct current)) to the destaticizing device 36 (see FIG. 1) by controlling a built-in voltage power supply according to an instruction of the printer control part 41. Three density sensors 60*a*, 60*b*, and 60*c* (that may be simply called density sensors 60 if no special distinction is necessary) are arranged so that the density sensors 60*a* and 60*b* are disposed at both ends of the transfer belt 23 on a line in the width direction of the transfer belt 23 (Y-axis direction) and that the density sensor 60*c* is disposed at the center of the transfer belt 23. Each of the density sensors 60 detects a band-shaped toner image due to light exposure that is transferred to the transfer belt 23 and extends in the width direction of the transfer belt 23, and sends the detection information to the printer control part 41.

A touch panel control part 45 controls the display of the touch panel 38 based on instructions from the printer control part 41, and further processes the input information of input data from the touch panel 38. Note that the printer control part 41 also performs sequence control over the whole image forming apparatus 11 by issuing instructions to an unshown fuser control part that controls the fuser 25, etc.

The normal print operation in the image forming apparatus 11 configured in the above-mentioned manner is explained referring to FIGS. 1 and 2.

First, a plurality of recording sheets 37 stacked in the sheet feeding tray 27 are forwarded sequentially from the top sheet by the hopping roller 28 that is rotationally controlled in the arrow direction by the printer control part 41, sent to the registration roller pairs 29 and 30 along the sheet guide part 33, thereby skew is corrected, subsequently sent from the registration roller pair 30 to the transfer belt 23, placed on this transfer belt 23, and sent to the image forming units 12K, 12Y, 12M, and 12C in order.

On the other hand, in each of the image forming units 12, the surface of the photosensitive drum 13 rotationally controlled in the arrow direction by the printer control part 41 and the development motor 56 is uniformly charged by the charging roller 14 to which a direct current voltage is applied by the charging voltage generation part 48 and exposed by the corresponding exposure head 15. At this time, the exposure head 15 irradiates the surface of the photosensitive drum 13 with light emitted based on image data sent from the host device 42 via the interface part 43 to form an electrostatic latent image on this surface.

Here, if −1100 V (charging voltage) is applied to the charging roller 14, the photosensitive drum 13 is charged to have a surface potential of about −500 V, and the latent image potential of a latent image pattern formed through exposure by the exposure head 15 becomes about −50 V.

On the part where the electrostatic latent image is formed, the toner 26 converted into a thin film on the development roller 16 electrostatically adheres to form a toner image of the corresponding color. At this time, accompanying the rotation of the photosensitive drum 13 in the arrow direction, the development roller 16 to which the development voltage is applied and the supply roller 18 to which the supply voltage is applied rotate keeping prescribed circumferential speed ratios in a different direction from that of the photosensitive drum 13.

In FIG. 1, the toner 26 accommodated in the toner accommodation part 20 is held in cells inside the supply roller 18 and rubbed between the supply roller 18 and the development roller 16, thereby carrying a negative charge. Also, the toner 26 carries charges moving between members to which voltages are applied. Then, the toner 26 carrying a charge adheres onto the development roller 16 by an electric field generated by a potential difference between the supply roller 18 and the development roller 16.

The toner 26 on the development roller 16 is regulated to have a uniform toner film thickness by the development blade 19, and also frictionally charged by being rubbed with the development blade 19 and the development roller 16. The toner 26 on the development roller 16 is carried to the electrostatic latent image on the photosensitive drum 13, and due to a potential difference between the electrostatic latent image and the development roller 16, adheres to the electrostatic latent image, thereby developing it. The toner 26 on the development roller 16 that was not developed is scraped off by the supply roller 18.

By the development, the toner image formed on each of the photosensitive drums 13 is transferred to the recording sheet 37 by the corresponding transfer roller 17, to which the transfer voltage (direct current) is applied by the transfer voltage generation part 51. This transfer is executed sequentially one over another at timing that the recording sheet 37 reaches each transfer part (nip part between the photosensitive drum 13 and the transfer roller 17) carried by the transfer belt 23, thereby a color toner image is formed on the recording sheet 37. After the transfer, the toner 26 remaining on each of the photosensitive drum 13 (residual toner) is removed by the blade 24.

The recording sheet 37 on which the color toner image is formed by the transfer is sent to the fuser 25. Through the heat application and pressure application process by this fuser 25, the color toner image is fused to the recording sheet 37, forming a color image. The recording sheet 37 on which the color image is formed is carried along the sheet guide part 34 by the carrying roller pair 31 and ejected to the sheet stacker part 35 by the ejection roller pair 32. Through such processes as the above, the color image is formed on the recording sheet 37.

Next, explained is a light exposure coping process performed by the image forming apparatus 11 of this embodiment. Light exposure here means that the photosensitive drum 13 is exposed to external light at the time of maintenance of the apparatus, etc. For example, if the top cover 39 (FIG. 1) of the image forming apparatus 11 is opened, and the image forming unit 12 containing the photosensitive drum 13 is removed as shown in FIG. 1, part of the surface of the photosensitive drum 13 that contacts with the transfer belt 23 through an opening part on the bottom part (a rectangular opening part extending in the axial direction of the photosensitive drum 13) is exposed to external light in a band shape along the axial direction.

If the surface of the photosensitive drum 13 is exposed to light in this manner, optical properties of the part exposed to light change, making its charged voltage lower than the other part after charging by the charging roller 14 in the normal printing. Thereby, a band-shaped toner image extending in the axial direction of the photosensitive drum 13 is formed on the light-exposed part and is printed on the print surface of the recording sheet 37 through the transfer by the transfer roller 17. Therefore, if the band-shaped toner image is formed by light exposure, the print quality declines.

In the light exposure coping process performed by the image forming apparatus 11 of this embodiment, a band-shaped toner image formed by the photosensitive drum 13 being exposed to light is transferred to the transfer belt 23, and this band-shaped toner image is detected with the density sensors 60. Then, if the band-shaped toner image is detected, it is judged that the photosensitive drum 13 has been exposed to light, a below-mentioned light exposure improvement process for reducing the effect of this light exposure is performed, and according to its result, a coping process is further performed.

Figure 3:
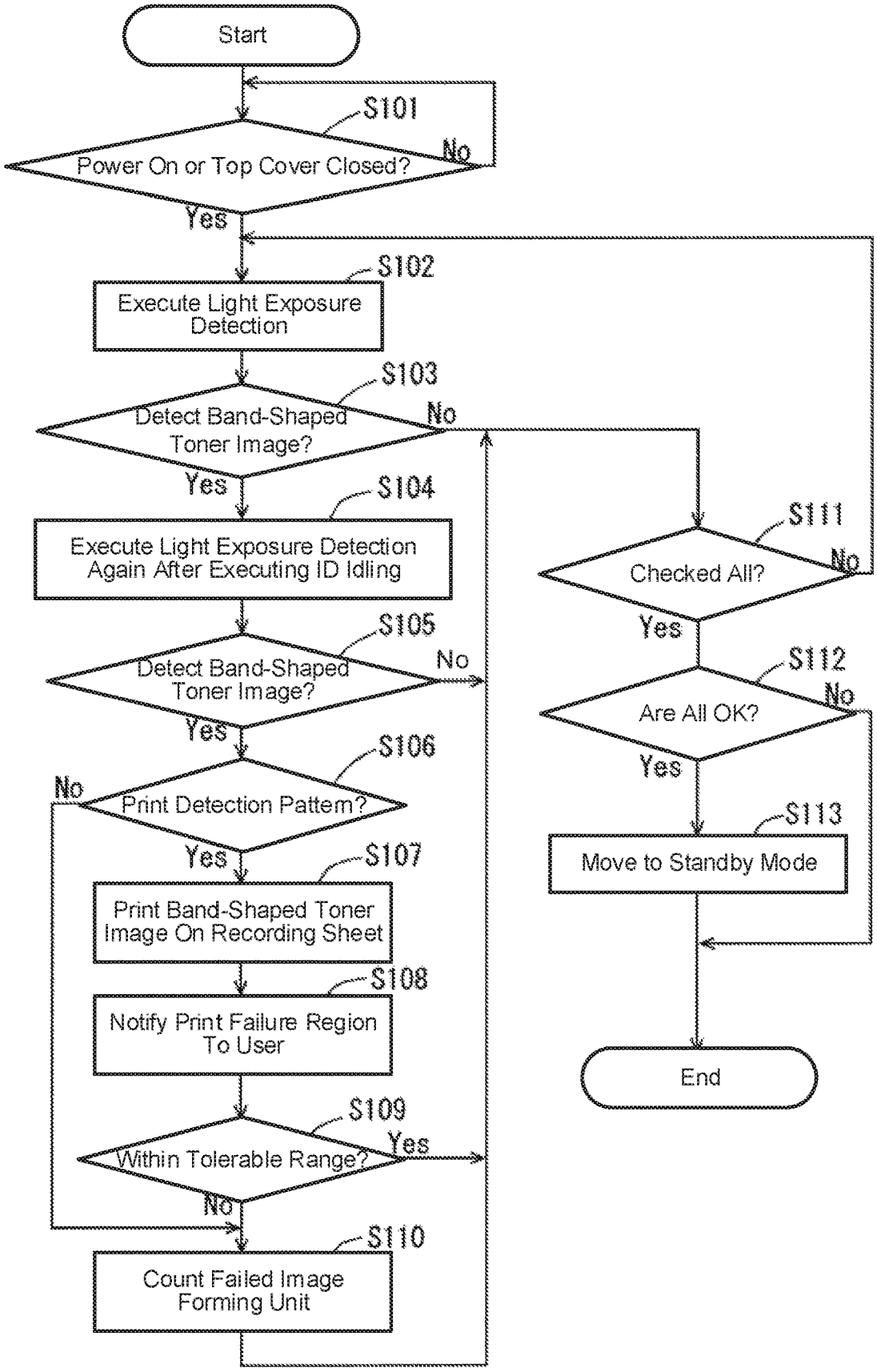
FIG. 3 is a flow chart showing the flow of a light exposure coping process performed by a printer control part in Embodiment 1.

FIG. 3 is a flow chart showing the flow of the light exposure coping process performed by the printer control part 41. Referring to this flow chart, the light exposure coping operation is further explained.

In this flow, first monitoring whether the power of the apparatus has been turned on or whether the top cover 39 of the apparatus has been closed after it was once opened (S101), once it is confirmed that the power has been turned on or the top cover 39 has been closed (Yes in S101), various operations for detecting light exposure are executed (S102). Note that although the image forming apparatus 11 normally performs a transfer voltage correction at this timing for correcting a transfer current that comes into different states depending on the environment inside the apparatus, these processes can be started in parallel (or simultaneously) for saving time.

Also, although omitted here, in a stage preceding S102 where various operations for detecting light exposure are executed, it is preferred to execute (or install) a process in which the transfer belt 23 is idled in a state where all the image forming units 12 are moved to the standby positions, the existence of residual toner on the transfer belt 23 is detected (or checked, sensed, confirmed) by the density sensors 60, and if its existence is confirmed, it is removed by the residual toner removal device 40. In the embodiments, the idling of the transfer belt 23 means to rotate the belt at least one time around its axis without any developing steps. Putting it another way, the idling means to drive the belt to rotate but not to develop its surface or not to put developer on its surface.

In this S102, the image forming unit 12 that becomes the checking target for light exposure detection is instructed to stop destaticizing light irradiation by the destaticizing device 36, apply a lower (in absolute value) charging voltage than that in the normal printing, stop exposure by the exposure head 15, and stop the hopping motor 58, the carrying motor 57, the ejection motor 59, etc., and further the other image forming units 12 than the image forming unit that becomes the checking target for light exposure detection are instructed to move to the standby positions and stop operations. Here, first the black (K) image forming unit 12K is made the checking target. At the standby portions, the image forming units are separated from the transfer belt 23 by a predetermined distance such that the transfer belt and image forming units electrically do not affect each other.

Note that the reason for applying a lower (in absolute value) charging voltage than that in the normal printing is to prevent the influence of a residual charge due to light exposure from becoming hard to appear by applying a high charging voltage.

In one embodiment, the lower charging voltage in absolute value may be ranged within 90% to 99% with respect to that in the normal printing. For example, in a case where the absolute value of the charging voltage in the normal printing is −1100V, the lower charging voltage varies between −995V and −1085V.

Other than that, the print process is performed in the same condition as in the normal printing. Thereby, if a band-shaped toner image based on light exposure is formed on the photosensitive drum 13K, this band-shaped toner image is directly transferred to the transfer belt 23. Here, the print process is performed at least during the time while the photosensitive drum 13K makes two rotations. Thereby, if light exposure exists, at least two rows of band-shaped toner images are formed on the transfer belt 23 with an interval of the circumferential length L of the photosensitive drum 13 (see FIG. 6) in its moving direction.

Note that here the reason why the other image forming units 12 than the image forming unit 12K that becomes the checking target for light exposure detection were moved to the standby positions is to prevent images that become noise from being transferred to the transfer belt 23 by these image forming units 12. Also, although here the other image forming units 12 than the image forming unit 12K that becomes the checking target for light exposure detection were moved to the standby positions, it may be configured so that a reverse bias voltage (a positive voltage here) of the opposite polarity to the development voltage (−200 V here) in the normal printing can be applied to the development roller 16 in each of the other image forming units 12 than the image forming unit 12K that becomes the checking target to prevent toner from moving to the photosensitive drum 13.

Next, the printer control part 41 monitors whether a band-shaped toner image due to light exposure has been detected on the transfer belt 23 with the three density sensors 60 (S103). In detecting this band-shaped toner image, specifically, each of the density sensors 60 is provided with a light emission part and a light receiving part that receives light emitted from this light emission part and reflected on the surface of the transfer belt 23, and sends the detection information of the band-shaped toner image corresponding to the received light level by this light receiving part to the printer control part 41.

Figure 4:
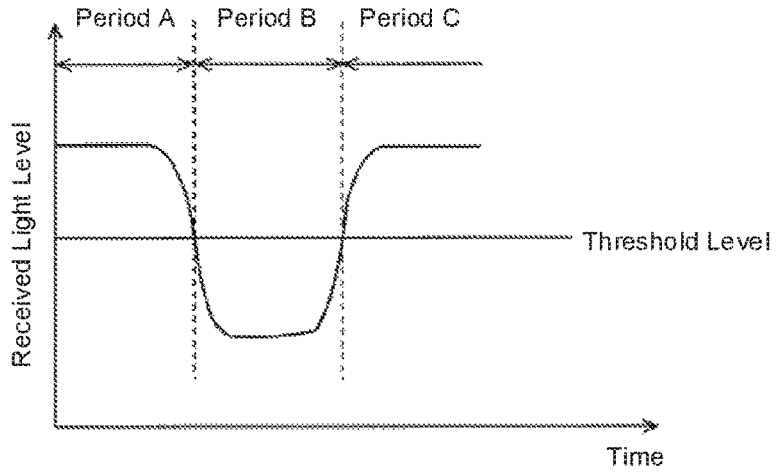
FIG. 4 is a waveform plot showing output level variation when density sensors have detected a band-shaped toner image due to light exposure.

FIG. 4 is a waveform plot showing the variation of an output level when the density sensors 60 have detected a band-shaped toner image due to light exposure, where the vertical axis represents the received light level, and the horizontal axis represents elapsed time. In general, the reflectivity of the band-shaped toner image transferred to the transfer belt 23 becomes lower than the reflectivity of the surface of the transfer belt 23, as shown in the same waveform plot, the received light levels during period A and period C where reflected light of the surface of the transfer belt 23 was received are higher than the received light level during period B where reflected light of the band-shaped toner image transferred to the transfer belt 23 was received. Periods A to C may be referred as time regions.

The printer control part 41 receives the detection information of the band-shaped toner image having a waveform shown in FIG. 4 from each of the density sensors 60, and detects a time range of the period B where the received light level of the detection information becomes no higher than a prescribed threshold level, thereby detecting the toner image.

However, in order to prevent false detections of the band-shaped toner image due to light exposure, the printer control part 41 judges that light exposure exists when both of the following detection conditions (1) and (2) are satisfied.

(1) Having detected a time range of the period B where the received light levels with the three density sensors 60*a*, 60*b*, and 60*c* disposed on a line almost simultaneously become no higher than the prescribed threshold level.

(2) Having detected at least two rows of band-shaped toner images formed with an interval of the circumferential length L of the photosensitive drum 13 in the condition (1).

With the above-mentioned conditions (1) and (2), false detections of light exposure are prevented.

If a band-shaped toner image due to light exposure is detected (Yes in S103), in order to remove a residual charge due to light exposure on the photosensitive drum 13K, the photosensitive drum 13K is idled over several rotations while continuing the irradiation of destaticizing light by the destaticizing device 36K and the application of a charging voltage by the charging roller 14K. Those processes are termed as a residual charge removal process, and they may be termed as a light exposure improvement process in the present invention. Note that at this time it is preferable to apply a reverse bias voltage (a positive voltage here) of the opposite polarity to the development voltage (−200 V here) in the normal printing to the development roller 16K in order to prevent toner from moving from the development roller 16K to the photosensitive drum 13K.

Further, in order to check whether the residual charge could be removed by this implementation, various operations for detecting light exposure are executed again (S104). Note that because the various operations for detecting light exposure here are the same as the various operations for detecting light exposure explained in S102, their explanations are omitted here.

On the other hand, if no band-shaped toner image due to light exposure is detected in S103 (No in S103), the system moves to S111 for judging whether the light exposure detection process is finished in all the image forming units 12.

In order to check the effect of the residual charge removal process (light exposure improvement process) in S104, the printer control part 41 monitors whether a toner image due to light exposure is detected on the transfer belt 23 with the three density sensors 60 (S105). Because the detection method here is the same as the light exposure detection method explained in S103, its explanation is omitted here.

If the band-shaped toner image due to light exposure stops to be detected in this S105 (No in S105), the system moves to S111 for judging whether the light exposure detection process is finished in all the image forming units 12, and if the band-shaped toner image due to the influence of light exposure continues to be detected (Yes in S105), a message indicating the existence of the band-shaped toner image due to light exposure is displayed on the display part of the touch panel 38 to warn the user, and further inquired of the user is whether to print the light exposure check pattern (band-shaped toner image) (S106).

In order to check the degree of the band-shaped toner image (detected pattern) when it is actually printed, once the print instruction is received from the user (Yes in S106), the band-shaped toner image (or Light Exposure Detection Pattern) is printed on the recording sheet 37 (S107), and the region where the toner image exists on the recording sheet 37 is displayed on the display part of the touch panel 38 to show it clearly to the user (S108). If the user judges that the image forming unit 12 being currently checked (12K here) failed without checking it with the actual printout (No in S106), the system moves to S110 for counting the failed image forming units.

Here, the process in S108 is explained referring to FIGS. 5 through 7B. In clearly showing the region on the recording sheet 37 where the band-shaped toner image printed on the recording sheet 37 exists, the printer control part 41 executes the following arithmetic process.

Figure 6:
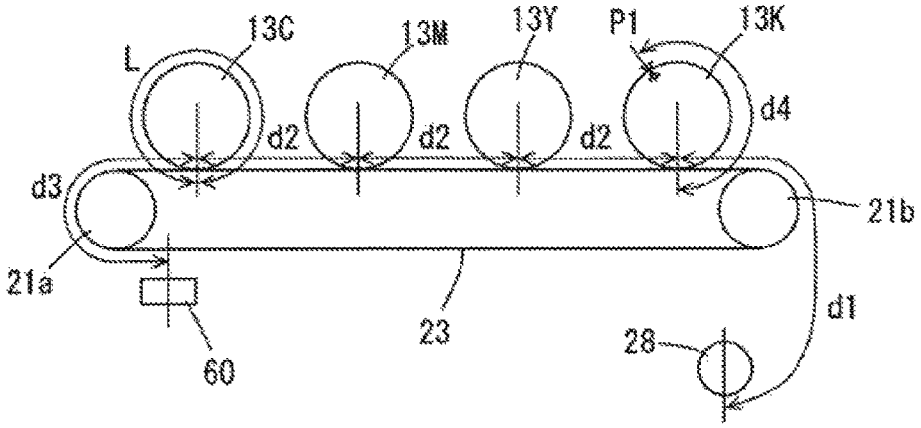
FIG. 6 is an internal dimensional drawing of the image forming apparatus that is necessary for obtaining the moving distance of the band-shaped toner image from the light exposure position of a photosensitive drum to the density sensors.

FIG. 6 is an internal dimensional drawing of the image forming apparatus 11 that is necessary for obtaining an image moving distance of the band-shaped toner image from a light exposure position P1 of the photosensitive drum 13K to the density sensors 60. In S107, if the band-shaped toner image formed on the photosensitive drum 13K is printed on the recording sheet 37, the image moving distance from the light exposure position P1 of the photosensitive drum 13K to the density sensors 60 shown in FIG. 6 is, for example, $$IMD=3\times d2+d3+d4$$

where IMD means the image moving distance, d2 is the distance between the photosensitive drums 13, d3 is the moving distance of the transfer belt 23 from the transfer position of the photosensitive drum 13C in the most downstream position in the carrying direction of the recording sheet 37 to the density sensors 60, and d4 is the circumferential distance from the light exposure position P1 of the photosensitive drum 13K to its transfer position.

On the other hand, the image moving distance (or IMD above) can be obtained from time t1 since the photosensitive drum 13 and the transfer belt drive roller 21*a* started rotating when the light exposure detection started in S104 until the band-shaped toner image is detected with the density sensors, and a moving linear velocity v1 of the transfer belt 23 (E=v1×t1). Therefore, here the rotation start position of the light exposure position P1 of the photosensitive drum 13K when printing starts in S107 needs to coincide with the rotation start position of the light exposure position P1 of the photosensitive drum 13K when the light exposure detection is started in S104.

Therefore, the circumferential distance d4 from the light exposure position P1 of the photosensitive drum 13K to its transfer position can be obtained by $$d4=E-(3\times d2+d3).$$

Figure 7A:
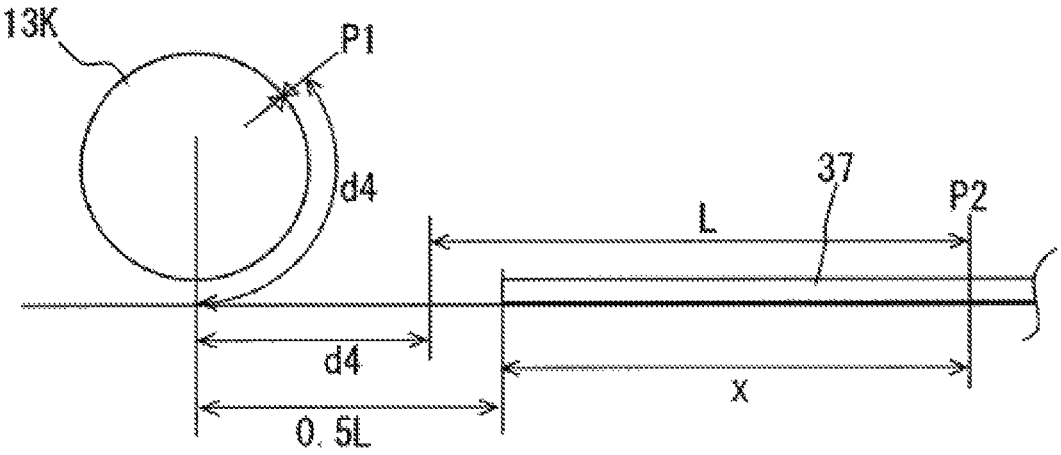
FIGS. 7A and 7B are diagrams for explaining the process in S108, where
Figure 7B:
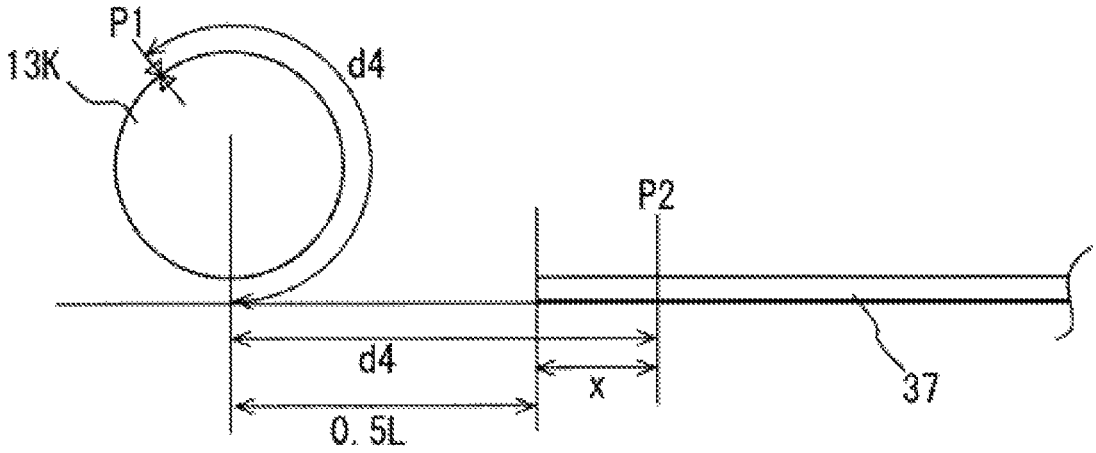

Here, explained referring to FIGS. 7A and 7B is that depending on the rotation start position of the light exposure position P1 of the photosensitive drum 13K when printing starts in S107, the printing position of the band-shaped toner image from the leading edge part of the recording sheet 37 is shifted by the circumferential length L of the photosensitive drum 13. Here, it is assumed that $$d1=2.5\times L$$

where d1 is the distance from the sheet feeding position by the hopping roller 28 to the transfer position of the photosensitive drum 13K, and L is the circumferential length of the photosensitive drum 13.

In this assumption, an estimate distance x of a print position P2 where the band-shaped toner image is printed on the recording sheet 37 at the first time from the leading edge part of the recording sheet 37 is calculated. If it is assumed that the rotation of the photosensitive drum 13K and the sheet feeding by the hopping roller 28 are performed simultaneously, when the leading edge part of the recording sheet 37 reaches 0.5 L before the transfer position of the photosensitive drum 13K, the photosensitive drum 13K has just made two rotations, therefore the light exposure position P1 returns to the rotational position at the start of rotation.

Therefore, if d4<0.5×L, as shown in FIG. 7A, the band-shaped toner image is transferred onto the recording sheet 37 for the first time at the second transfer, and its estimate distance x can be obtained by $$x=L-(0.5\times L-d4) \quad (1)$$

and if d4>0.5×L, as shown in FIG. 7B, the band-shaped toner image is transferred onto the recording sheet 37 starting at the first transfer, and its estimate distance x can be obtained by $$x=d4-0.5\times L \quad (2)$$

where 0.5×L is the distance that is integer multiples (corresponding to the number of rotations of the photosensitive drum 13) of L subtracted from d1 (2.5×L), and is the reference value for comparing the distance from the leading edge part of the recording sheet 37 to the transfer position of the photosensitive drum 13K and the distance d4 from the light exposure position P1 to its transfer position at the same time.

Figure 5:
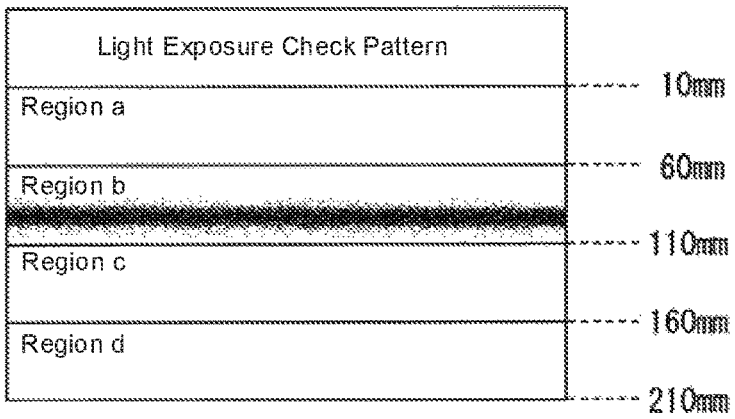
FIG. 5 is a diagram for explaining regions divided according to the distance from the leading edge part in the carrying direction of a recording sheet.

FIG. 5 is a diagram for explaining regions divided according to the distance from the leading edge part in the carrying direction of the recording sheet 37. Printing at this time is assumed to be the A4 landscape printing, and as shown in the same figure, the following regions are defined according to the distance from the leading edge part of the carrying direction of the recording sheet 37:

10 mm≤Region a<60 mm,
60 mm≤Region b<110 mm,
110 mm≤Region c<160 mm,
160 mm≤Region d<210 mm.

If the calculated estimate distance x falls into any of the above regions, the region is clearly shown to the user. However, if 0<x<10 mm, x'=x+L is defined, and x' is substituted for the above x. This is for preventing the transfer position at the first time from exceeding the sheet leading edge part due to fluctuations at the transfer time on the sheet leading edge part.

For example, as shown in FIG. 5, if the estimate distance x from the leading edge part of the recording sheet 37 of the print position P2 (FIGS. 7A and 7B) where the band-shaped toner image is printed onto the recording sheet 37 for the first time is in Region b, a message is displayed to the user, saying "Print failure occurred in Region b. Although the machine is still usable as it is, if the failure is outside your tolerable range, please replace the image forming unit 12K."

If the user looks at the print result and judges that it is within his tolerable range (Yes in S109), the system moves to S111 as it is, and if he judges it is outside his tolerable range (No in S109), the image forming unit 12 is counted as failed (S110), and the system moves to S111.

In S111, it is judged whether the light exposure detection process is finished in all the image forming units 12, and if there is at least one image forming unit 12 that has not performed the light exposure coping process (No in S111), S102 through S111 are repeated, for example, in the order of the image forming unit 12K, the image forming unit 12Y, the image forming unit 12M, and the image forming unit 12C to execute the light exposure coping process for each of the image forming units 12. Note that in returning from this S111 to S102, the transfer voltage correction explained above is not performed.

Once the light exposure detection process is finished in all the image forming units 12 (Yes in S111), if there was no influence of light exposure or the influence was within a tolerable range even if it existed in any of the image forming units 12 (Yes in S112), the system moves to a standby mode for waiting for the normal printing (S113), and if there is at least one image forming unit 12 that is judged as failed (No in S112), the light exposure coping process is finished as it is.

Note that in the image forming apparatus of Embodiment 1, in S106 shown in FIG. 3, if the user judges that printing is unnecessary (No in S106), it was interpreted as an example that the user's intention was to regard the corresponding image forming unit 12 as failed. However, if it is interpreted that the user thought it was okay to print the band-shape toner image, the system may move to S111 as it is.

As stated above, according to the image forming apparatus of this embodiment, if there is an influence of light exposure on the photosensitive drum 13, the residual charge removal process (light exposure improvement process) is executed, and if no improvement is still made, a band-shaped toner image due to the influence of light exposure is actually printed so that the user can judge whether that degree of print quality is tolerable, therefore the timing to replace the image forming units 12 due to light exposure can be appropriately judged.

Modification 1 of Embodiment 1

In Modification 1 of Embodiment 1, in the flow chart showing the flow of a light exposure detection process performed by a printer control part 41 shown in FIG. 3, for example, a photosensitive drum 13 rotation stop step is installed before/after S110, and in this rotation stop step, a photosensitive drum 13 is stopped when the light exposure position P1 of the photosensitive drum 13 shown in FIGS. 7A and 7B is in the lowest position (transfer position) exposed to the outside of an image forming unit 12.

In this case, because the printer control part 41 knows the circumferential distance d4 from the transfer position to the light exposure position P1 regardless of printing or not printing the detected pattern in S106, if the detected pattern is not printed, it can rotate the photosensitive drum 13 by the circumferential distance d4 and stop, and if the detected pattern is printed, after rotating by a prescribed number of times necessary for printing, it can rotate the photosensitive drum 13 by the circumferential distance d4 and stop, thereby performing the process.

In this manner, according to the image forming apparatus of Modification 1 of Embodiment 1, because the photosensitive drum 13 is stopped where its light exposure position P1 is in the lowest position exposed to the outside of the image forming unit 12, it becomes easy for the user to check visually the light exposure position P1 or its state.

Modification 2 of Embodiment 1

Although in Embodiment 1 the user judged the degree of the band-shaped toner image printed on the recording sheet 37 in S109 of the flow chart in FIG. 3, in Modification 2 of Embodiment 1 here, the degree of a band-shaped toner image printed at this time is detected by density sensors 60 for example, the degree of the density is categorized into a plurality of ranks, and the visual level tolerated by the user and the tolerable rank of the density of the band-shaped toner image detected at that time are associated. The accuracy of this association increases by acquiring data multiple times.

Once a prescribed number of data are acquired or according to an instruction by the user, at one point of time, instead of S108 and S109 of the flow chart in FIG. 3, a printer control part 41 moves directly to S111 if the density of the band-shaped toner image detected at that time is equal to or less than the tolerable rank, and moves to S111 via S110 if it is higher than the tolerable rank.

In this manner, according to Modification 2 of Embodiment 1, by grasping the degree of print quality tolerated by the user, without actually asking the user to judge, a judgement intended by the user can be performed, allowing the light exposure coping process to be performed more smoothly.

Embodiment 2

Figure 8A:
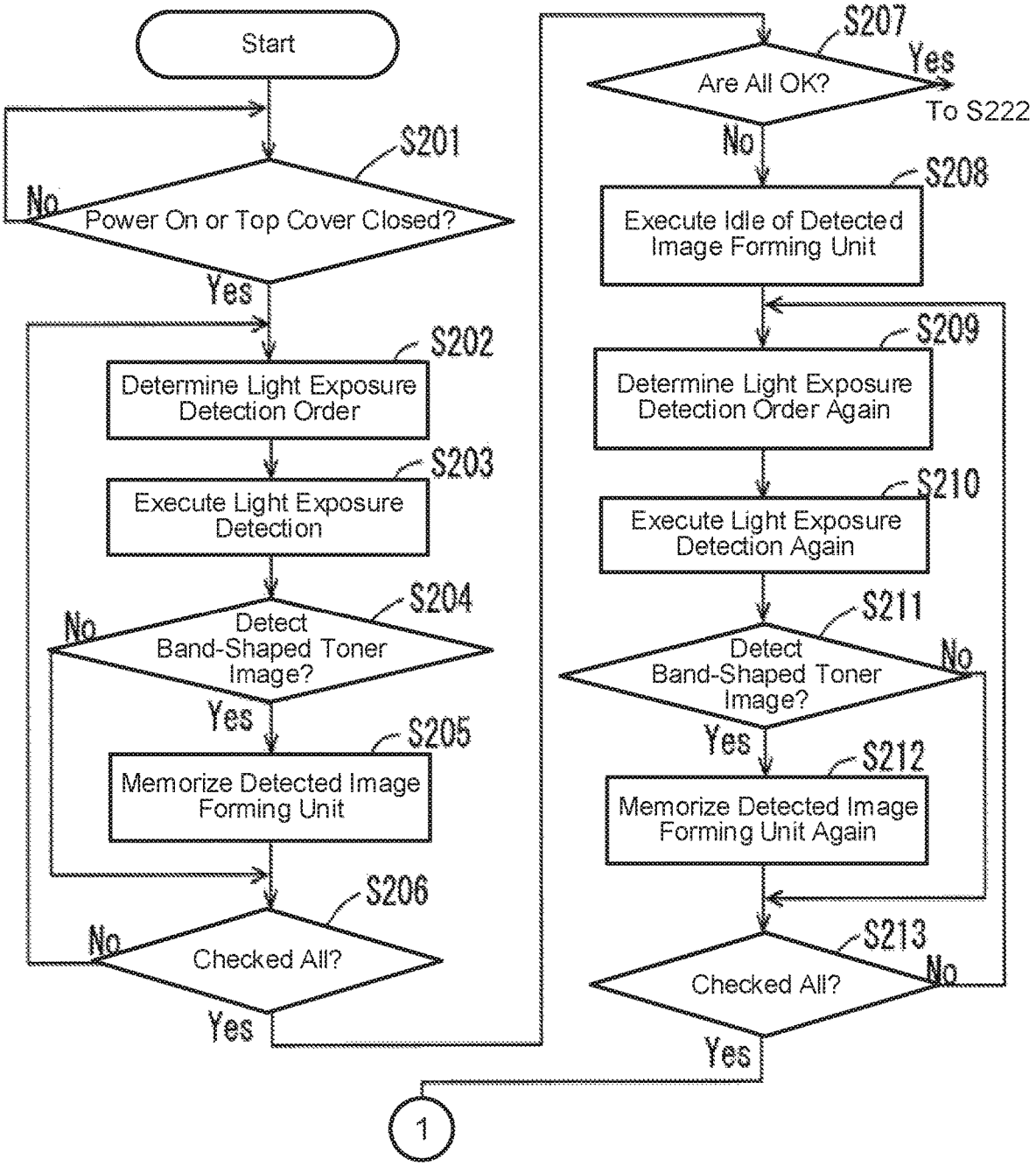
FIGS. 8A and 8B are flow charts showing the flow of a light exposure coping process executed by a printer control part in Embodiment 2.
Figure 8B:
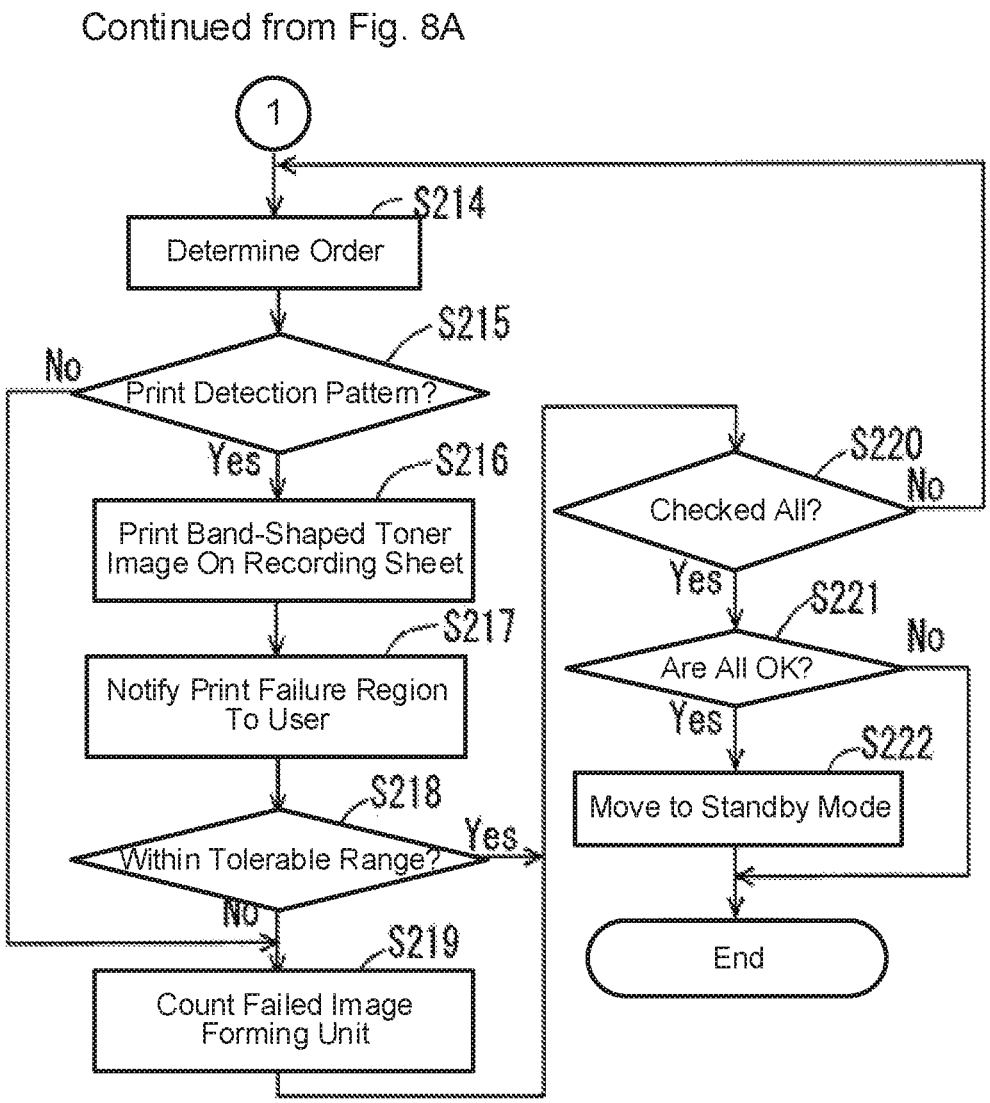

FIGS. 8A and 8B are flow charts showing the flow of a light exposure coping process executed by a printer control part in Embodiment 2.

Although the printer control part 41 of Embodiment 1 performed a series of processes of the light exposure detection process, the light exposure improvement process, the process to check its effect, and the process to judge whether to print the band-shaped toner image and evaluate it when no improvement was made separately for each of the four image forming units 12, here each process is performed to all applicable image forming units 12 at once.

Therefore, parts of the image forming apparatus of this embodiment that are common with those of the image forming apparatus 11 of Embodiment 1 mentioned above are given the same codes, or their drawings and explanations are omitted, and different points are mainly explained. Note that the main part configuration of the image forming apparatus of this embodiment is common with that of the image forming apparatus 11 of Embodiment 1 shown in FIGS. 1 and 2 except for the above-mentioned point, therefore FIGS. 1 and 2 are referred to as necessary. Also, although the printer control part of this embodiment executes different processes from those of the printer control part 41 of Embodiment 1, for convenience the same codes are given to all the components in the explanations here.

Referring to the flow charts in FIGS. 8A and 8B, the light exposure detection operation in this embodiment is further explained.

First, monitoring whether the power of the apparatus has been turned on or whether a top cover 39 of the apparatus has been closed after it was once opened (S201), and once it is confirmed that the power has been turned on or the top cover 39 has been closed (Yes in S201), the order to perform the light exposure detection process (or light exposure detection order) in the four image forming units 12 is determined (S202). It is assumed here that an image forming unit 12K is checked first.

Various operations for light exposure detection are performed to the image forming unit 12K (S203), and whether a band-shaped toner image due to light exposure has been detected on a transfer belt 23 is monitored (S204). Note that because processes in S203 and S204 here are totally the same as those in S102 and S103 in the flow chart in FIG. 3 mentioned above, their detailed explanations are omitted here.

If a band-shaped toner image due to light exposure is detected (Yes in S204), the image forming unit 12 being currently checked is memorized in a memory part (RAM) (S205), afterwards the system moves to S206, and if no band-shaped toner image due to light exposure is detected (No in S204), the system moves to S206 as it is. In S206, whether the light exposure detection process has been performed for all the image forming units 12 is checked, if the light exposure detection process is not finished for all the image forming units 12 (No in S206), the system returns to S202, and S202 through S206 are repeated according to a predetermined order until the light exposure detection process is finished for all the image forming units 12 (Yes in S206).

Once the light exposure detection process is finished for all the image forming units 12, whether there was no influence of light exposure in all the image forming units 12 is checked (S207). Here, if there was no influence of light exposure in any of the image forming units 12 (Yes in S207), the system proceeds to S222 to move into the standby mode for waiting for the normal printing, and if there was at least one image forming unit 12 having an influence of light exposure (No in S207), the system proceeds to S208 to move into a light exposure improvement process.

Here, the light exposure improvement process (or Idle of Detected Image Forming Unit) is executed at once to the at least one image forming unit 12 where a band-shaped toner image due to light exposure was detected (that may be hereafter called light-exposed image forming unit 12) memorized in S205 (S208). Note that this process in S208 is a process to remove a residual charge due to light exposure on the photosensitive drum 13, that is totally the same as the residual charge removal process (light exposure improvement process) executed in the first half of S104 in the flow chart in FIG. 3 mentioned above, therefore its detailed explanation is omitted here.

Next, for the image forming units 12 where light exposure occurred and the residual charge removal process (light exposure improvement process) was performed (that may hereafter be called processed image forming units), the order to perform the light exposure detection process again is determined (S209). Here, the order they were listed up in S205 is adopted. Next, for the processed image forming units 12, various operations for the light exposure detection are executed again (S210), and whether a band-shaped toner image due to light exposure is detected on the transfer belt 23 is monitored (S211). Note that because the processes in S210 and S211 here are totally the same as those in S102 and S103 in the flow chart in FIG. 3 mentioned above, their detailed explanations are omitted here.

If a band-shaped toner image due to light exposure is detected again (Yes in S211), the image forming unit 12 being currently checked is memorized in the memory part (RAM) (S212), afterwards the system moves to S213, and if no band-shaped toner image due to light exposure is detected (No in S211), the system moves to S213 as it is. In S213, it is checked whether the light exposure detection process has been performed again for all the image forming units 12 where light exposure occurred and the residual charge removal process was performed, and if the repeated light exposure detection process is not finished for all the above-mentioned image forming units 12 (No in S213), the system returns to S209, and S209 through S213 are repeated according to a predetermined order until the light exposure detection process is finished for all the above-mentioned applicable image forming units 12.

Next, the system moves to a process to judge whether to print a band-shaped toner image and evaluate it when no improvement was made (that may hereafter be simply called printing evaluation process). First, for the image forming units 12 where a band-shaped toner image was detected even after performing the light exposure improvement process (that may hereafter be called image forming units 12 having the light exposure influence not totally removed), the order to perform the printing evaluation process is determined (S214). Here, the order they were listed up in S212 is adopted. Next, the printing evaluation process is performed to the image forming unit 12 specified in the order.

That is, a message indicating the existence of a band-shaped toner image due to light exposure is displayed on the display part of a touch panel 38 to warn the user, the user is further asked whether to print a light exposure check pattern (band-shaped toner image) (S215), once a print instruction is received from the user for checking the degree of the band-shaped toner image (detected pattern) when it is actually printed (Yes in S215), the band-shaped toner image is printed on a recording sheet 37 (S216), and the region the toner image exists on the recording sheet 37 is displayed on the display part of the touch panel 38 to be clearly shown to the user (S217). If the user judges that the image forming unit 12 that is the current checking target of light exposure detection failed without checking it with the actual printout (No in S215), the system moves to S219 for counting the failed image forming units 12.

If the user looks at the printing result and judges it is within a tolerable range (Yes in S218), the system moves to S220 as it is, and if the user judges it is outside the tolerable range (No in S218), it is counted as a failed image forming unit 12 (S219), and the system moves to S220.

Note that because processes in S215 through S219 here are totally the same as those in S106 through S110 in the flow chart in FIG. 3 mentioned above, their detailed explanations are omitted here.

In S220, it is checked whether the printing evaluation process has been performed for all the image forming units 12 having the light exposure influence not totally removed, and if the printing evaluation process is not finished for all the image forming units 12 mentioned above (No in S220), the system returns to S214, and S214 through S220 are repeated according to a predetermined order until the printing evaluation process is finished for all the above-mentioned applicable image forming units 12 (Yes in S220).

Once the printing evaluation process is finished for all the applicable image forming units 12, if the count value in S218 is 0, that is, if there was no influence of light exposure or the influence was within a tolerable range in any of the four image forming units 12 (Yes in S221), the system moves to a standby mode for waiting for the normal printing (S222), and if there was at least one image forming unit 12 judged as failed (No in S221), the light exposure coping process is finished as it is.

As stated above, according to the image forming apparatus of this embodiment, all the four image forming units 12 are processed in every process of the light exposure detection process, the light exposure improvement process, the process to check its effect, and the process to judge whether to print a band-shaped toner image and evaluate it when no improvement was made. Therefore, for example, once it becomes clear in S207 that there is no influence of light exposure in any of the image forming units 12, the light exposure coping process can be finished, and in S208 the residual charge removal process (light exposure improvement process) can be executed to all the applicable image forming units 12 at once, allowing to obtain effects such as reducing the number of processes and processing time in the light exposure coping process.

Modification 1 or Embodiment 2

Figure 9:
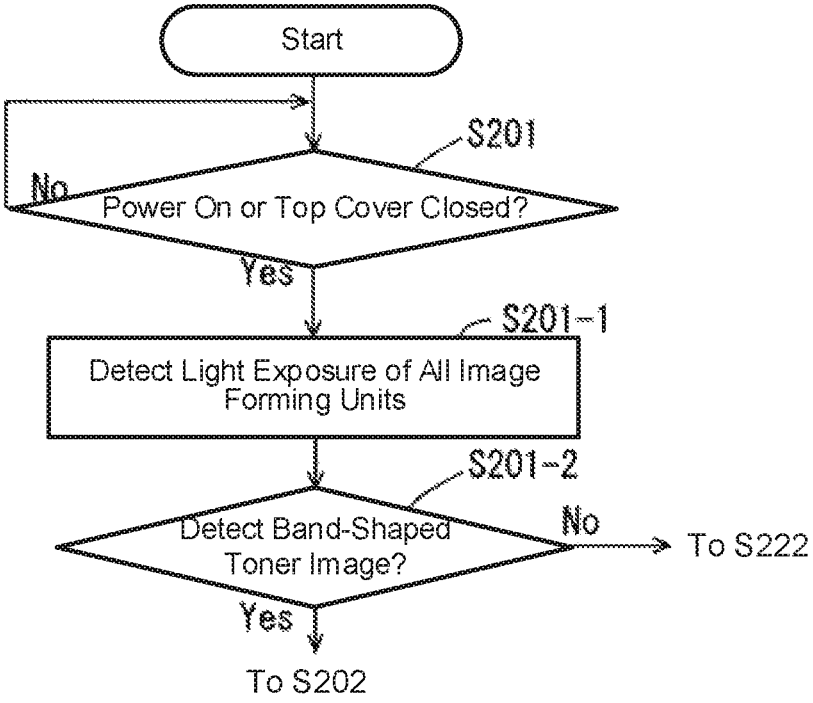
FIG. 9 is part of a flow chart showing the flow of a light exposure detection process executed by a printer control part in Modification 1 of Embodiment 2.

FIG. 9 is part of a flow chart showing the flow of a light exposure detection process executed by a printer control part 41 in Modification 1 of Embodiment 2.

The printer control part 41 in this modification executes the light exposure coping process where S201-1 and S201-2 are added between S201 and S202 as shown in FIG. 9 in addition to the light exposure detection process based on the flow chart in FIG. 8 mentioned above.

That is, once it is confirmed that the power has been turned on or the top cover 39 has been closed (Yes in S201), first, various operations for detecting light exposure are executed for all image forming units 12 (S201-1), and whether a band-shaped toner image due to light exposure has been detected on a transfer belt 23 is monitored (S201-2). Here, if even one band-shaped toner image is detected (Yes in S201-2), because it signifies that at least one image forming unit 12 has a photosensitive drum 13 exposed to light, the system moves to S202, and thereafter the light exposure detection process explained in Embodiment 2 is performed.

On the other hand, if no band-shaped toner image has been detected (No in S201-2), because it can be judged that all the image forming units 12 have a normal photosensitive drum 13 without light exposure, the system moves directly to a standby mode (S222).

In this manner, according to an image forming apparatus of Modification 1 of Embodiment 2, if all the photosensitive drum 13 have no influence of light exposure, because that fact can be confirmed in an early stage after starting the light exposure coping process, the system can move to the standby mode in S222 with the minimum necessary number of processes or processing time.

Modification 2 of Embodiment 2

Figure 10:
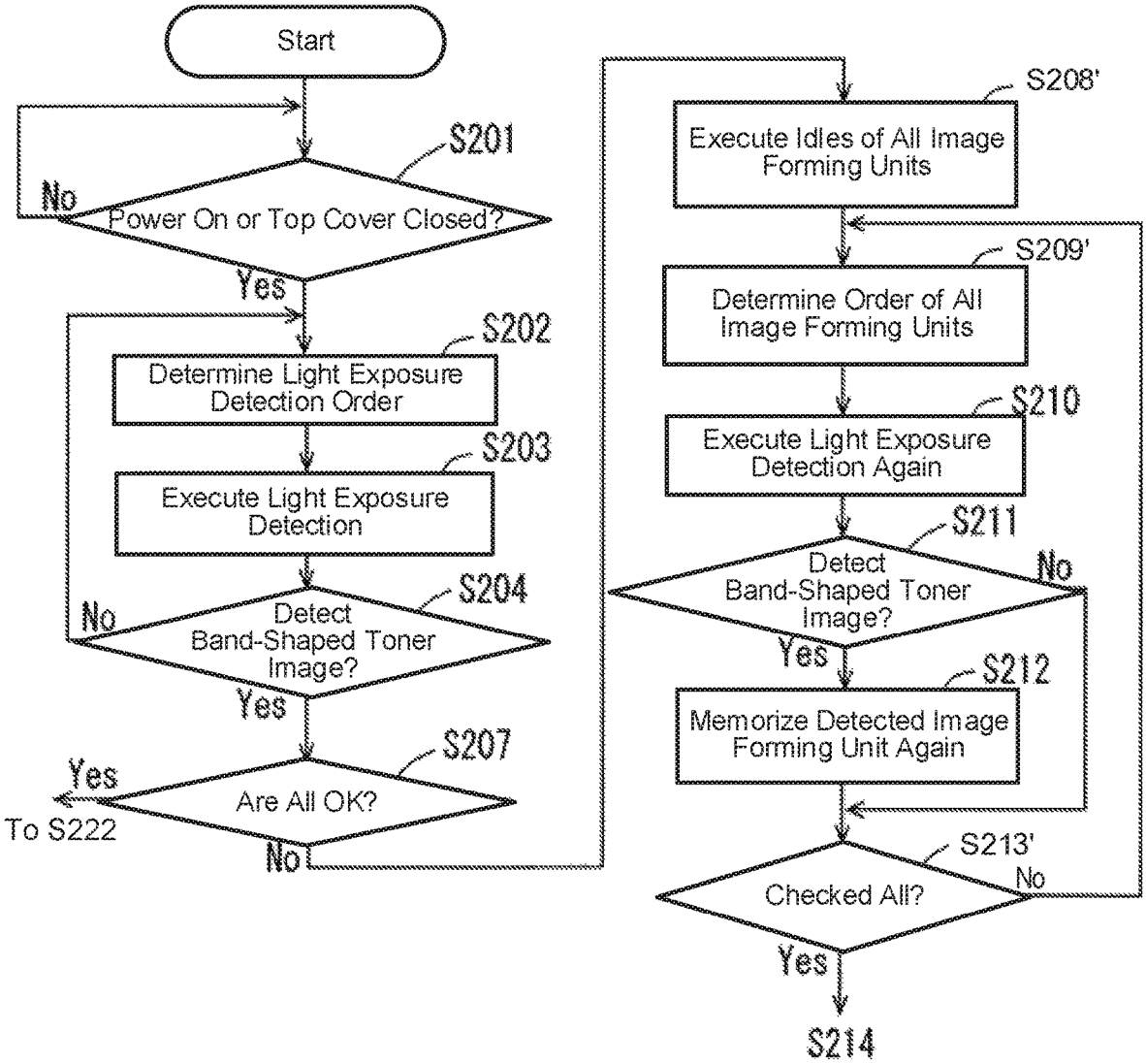
FIG. 10 is part of a flow chart showing the flow of a light exposure detection process executed by a printer control part in Modification 2 of Embodiment 2.

FIG. 10 is part of a flow chart showing the flow of a light exposure detection process executed by a printer control part 41 in Modification 2 of Embodiment 2.

The printer control part 41 in this modification performs processes in S201 through S213' shown in FIG. 10 substituting for the processes in S201 through S213 of the light exposure detection process based on the flow chart in FIG. 8. Note that in the flow chart in FIG. 10, steps that perform the same processes with those in the flow chart in FIG. 8 are given the same step numbers, and corresponding steps that perform partially different processes are distinguished by adding a "'".

Here, in S202 through S204, various operations for light exposure detection (S203) and monitoring of a band-shaped toner image due to light exposure formed on a transfer belt 23 (S204) are sequentially executed according to a predetermined order for four image forming units 12. In that process, once a band-shaped toner image due to light exposure is first detected (Yes in S204 and No in S207), a light exposure improvement process is executed to all the image forming units 12 at once (S208'), and the various operations for light exposure detection (S210) and the monitoring of a band-shaped toner image due to light exposure formed on the transfer belt 23 (S211) are executed again sequentially in the predetermined order, here from the image forming unit 12 disposed in the upstream side.

Note that if all the image forming units 12 have no influence of light exposure (Yes in S207), the system proceeds to S222 (see FIG. 8) to move into a standby mode for waiting for the normal printing.

Because a printing evaluation process in S214 and thereafter is totally the same as in S214 through S222 in the flow chart in FIG. 8 mentioned above, its detailed explanation is omitted here.

Note that in the printer control part of this Modification 2, the order to execute the light exposure detection process in the four image forming units 12 is predetermined in S202, and because the more frequently a photosensitive drum 13 is used, the more likely it suffers light exposure, this order should preferably be determined to start with the image forming unit 12 provided with the most frequently-used photosensitive drum 13. Here, a black (K) image forming unit 12(K) that is the most frequently used is determined to be the first.

By setting in this manner, the probability that the band-shaped toner image detection in S204 is performed in an early stage increases, leading to a reduction of light exposure detection processing time.

As stated above, according to the image forming apparatus of Modification 2 of Embodiment 2, if it is detected that even one of the four image forming units 12 has an influence of light exposure, a residual charge removal process (light exposure improvement process) is performed to all the image forming units 12. Therefore, if there is high probability that the photosensitive drums 13 of a plurality of the image forming units 12 are simultaneously exposed to light, the light exposure detection process can be efficiently performed.

Modification 3 of Embodiment 2

Figure 11A:
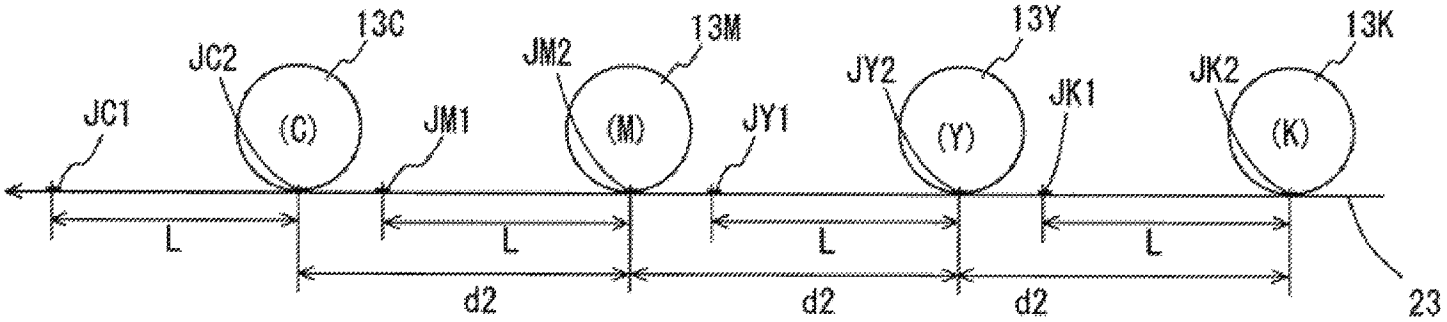
FIGS. 11A-11C are diagrams for explaining the operations of Modification 3 of Embodiment 2.
Figure 11B:
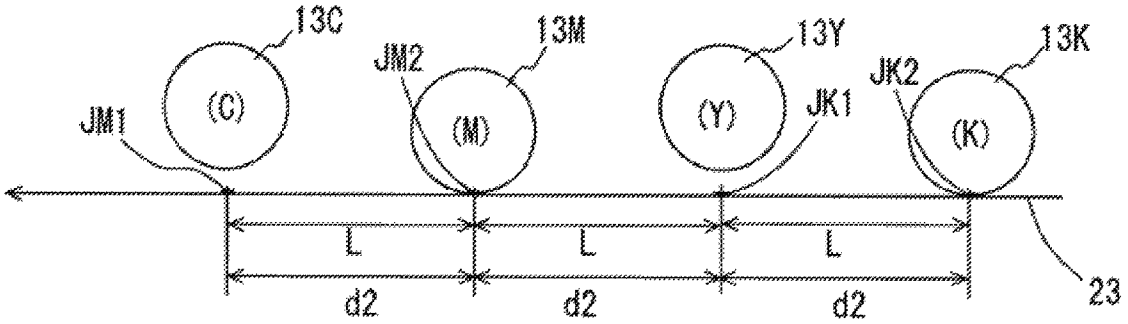
Figure 11C:
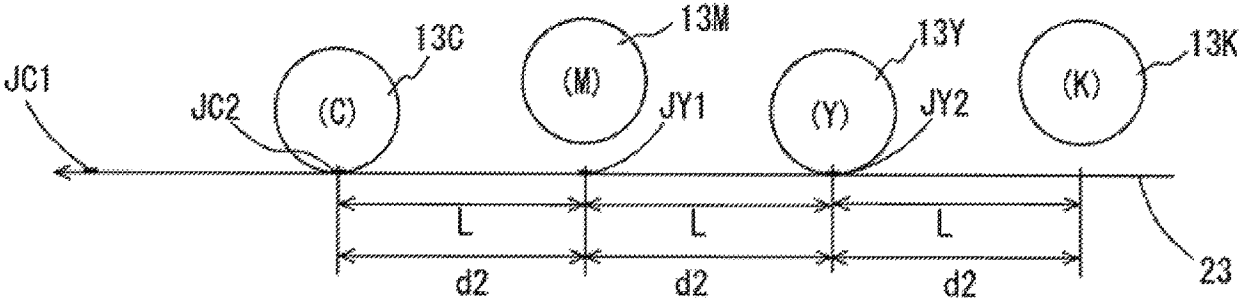

FIGS. 11A-11C are diagrams for explaining the operations of Modification 3 of Embodiment 2. In Embodiment 2, as shown in the flow chart in FIG. 8, in the light exposure detection process in S202 through S206, whether a band-shaped toner image due to light exposure was detected was checked sequentially for the photosensitive drums 13 of the four image forming units 12. However, here a light exposure detection process is performed simultaneously for photosensitive drums 13 of a plurality of image forming units 12.

As shown in FIG. 11A, if an interval d2 between the neighboring photosensitive drums 13 of the four image forming units 12 is longer than the circumferential length L of the photosensitive drums 13, even if band-shaped toner images due to light exposure are formed for two rotations simultaneously by the photosensitive drums 13, as shown in the same figure, two band-shaped toner images JK1 and JK2 formed by a photosensitive drum 13K, two band-shaped toner images JY1 and JY2 formed by a photosensitive drum 13Y, two band-shaped toner images JM1 and JM2 formed by a photosensitive drum 13M, and two band-shaped toner images JC1 and JC2 formed by a photosensitive drum 13C are formed sequentially on a transfer belt 23 with a prescribed interval.

Therefore, if band-shaped toner images are detected, density sensors 60 and a printer control part 41 that detect and analyze them can easily calculate which photosensitive drum(s) 13 formed the detected band-shaped toner images. Therefore, through the one-time light exposure detection process, the image forming unit(s) 12 that formed band-shaped toner images due to light exposure can be specified and memorized in the memory part (RAM).

Because processes hereafter are performed according to S207 and thereafter in the flow chart in FIG. 8 mentioned above, their explanations are omitted here.

Next, as shown in FIGS. 11B and 11C, the light exposure detection process when the interval d2 between the neighboring photosensitive drums 13 of the four image forming units 12 is equal to the circumferential length L of the photosensitive drums 13 is explained.

In this case, if band-shaped toner images are formed for two rotations of the photosensitive drums 13 simultaneously in the image forming units 12, the first-formed band-shaped toner images would overlap with the second band-shaped toner images formed by the neighboring downstream-side photosensitive drums 13.

Therefore, here, among the image forming units 12, the light exposure detection process is executed first for odd-numbered image forming units 12 from the upstream side as shown in FIG. 11B. At this time, as shown in the same figure, even-numbered image forming units 12 are moved to standby positions where their photosensitive drums 13 are separated from the transfer belt 23. Upon detecting a band-shaped toner image in this state, the density sensors 60 and the printer control part 41 calculate which photosensitive drum 13 of the odd-numbered image forming units 12 formed the detected band-shaped toner image, thereby specifying the image forming unit 12 that formed the band-shaped toner image due to light exposure, and memorize it in the memory part (RAM).

Next, among the image forming units 12, the light exposure detection process is executed for the even-numbered image forming units 12 from the upstream side as shown in FIG. 11C. At this time, as shown in the same figure, the odd-numbered image forming units 12 are moved to the standby positions where their photosensitive drums 13 are separated from the transfer belt 23. Upon detecting a band-shaped toner image in this state, the density sensors 60 and the printer control part 41 calculate which photosensitive drum 13 of the even-numbered image forming units 12 formed the detected band-shaped toner image, thereby specifying the image forming unit 12 that formed the band-shaped toner image due to light exposure, and memorize it in the memory part (RAM).

Because processes hereafter are performed according to S207 and thereafter in the flow chart in FIG. 8 mentioned above, their explanations are omitted here.

Note that although shown here was an example of executing the light exposure detection processes simultaneously for a plurality of image forming units 12 as a substitute for S202 through S206 shown in FIG. 8, if a plurality of the image forming units 12 are exposed to light, the same light exposure detection process can be executed again in S209 through S213 shown in FIG. 8 as their substitute.

As stated above, according to the image forming apparatus of Modification 3 of Embodiment 2, the number of processes or process time of the light exposure detection process can be reduced.

Although explained as an example in this embodiment was a tandem-type color printer provided with a plurality of development units as an image forming apparatus, in addition to a color printer, this invention is also useful for other image forming apparatuses such as a copier, a facsimile machine, and an MFP (MultiFunction Peripheral) that combines the functions of these apparatuses. Also, it is useful for a monochrome image forming apparatus with one image forming unit.

(Other features) The image forming apparatus of the invention may comprise a panel that displays messages to a user and takes input of instructions from the user, wherein after performing the cleaning sequence, the control part executes the light exposure detection process again, and if the developer image is detected again, notifies the user through the panel that there is an influence of light exposure. The control part may notify the user of a message through the panel to guide the user to the position of the developer image printed on the recording medium.

What is claimed is:

1. An image forming apparatus that can perform printing by an electrophotographic method, comprising:

an image forming unit that is composed with a photosensitive body that is rotatable and has a surface to be charged, a cleaning part that reduces potential differences on the surface of the photosensitive body due to a residual charge generated by a light exposure wherein the light exposure means to expose the surface of the photosensitive body to light, a charging part that charges the surface of the photosensitive body by applying a charging voltage, and a development part to which a development voltage is applied, and that carries a charged developer while the development part rotates, is arranged to oppose the surface of the photosensitive body, and is configured to form a developer image by moving the charged developer to the surface of the photosensitive body in correspondence with the potential differences on the surface of the photosensitive body due to the light exposure, and an exposure part that exposes the charged surface of the photosensitive body with light to form an electrostatic latent image having the potential differences, a control part, a sensor that executes a light exposure detection process to detect the developer image transferred onto a transfer-target member and sends detection information of the developer image, which is derived from a result of the light exposure detection process, to the control part, a voltage application part that is controlled by the control part to apply the charging voltage, the development voltage, and a transfer voltage for transferring the developer image, and an exposure control part that is controlled by the control part and controls the exposure part, wherein in a state where the exposure part is suspended in order not to form the electrostatic latent image, the control part applies the charging voltage, the development voltage, and the transfer voltage, and afterwards executes the light exposure detection process using the sensor, and if a developer image of threshold, which indicates that a light exposure occurred, is detected, the control part executes a cleaning sequence of the photosensitive body using the cleaning part.

2. An image forming apparatus that can perform printing by an electrophotographic method, comprising:

an image forming unit that is composed with a photosensitive body that is rotatable and has a surface to be charged, a destaticizing device that reduces potential on the surface of the photosensitive body, a charging part that charges the surface of the photosensitive body by applying a charging voltage, and a development part to which a development voltage is applied, and that carries a charged developer while the development part rotates, is arranged to oppose the surface of the photosensitive body, and is configured to form a developer image by moving the charged developer to the surface of the photosensitive body in correspondence with potential differences that are present on the surface of the photosensitive body, an exposure part that exposes the surface of the photosensitive body, which is charged with the charging part, to form an electrostatic latent image having the potential differences, a control part, a transfer part that transfers the developer image from the surface of the photosensitive body to a transfer-target member by a transfer voltage being applied, and a sensor that executes a light exposure detection process to detect the developer image transferred onto the transfer-target member with the transfer part and sends detection information of the developer image, which is derived from a result of the light exposure detection process, to the control part, wherein in a state where the exposure part is suspended in order not to form the electrostatic latent image, the control part applies the charging voltage, the development voltage, and the transfer voltage, and afterwards executes the light exposure detection process using the sensor, and if a developer image of predetermined amount is detected, the control part causes the destaticizing device to reduce the potential on the surface of the photosensitive body, which is defined as a cleaning sequence.

3. The image forming apparatus according to claim 2, wherein when the sensor executes the light exposure detection process of light exposure, the control part applies another charging voltage of which its absolute value is smaller than that of the charging voltage applied in a normal printing.

4. The image forming apparatus according to claim 2, wherein the photosensitive body is a drum-shaped body that is rotatable, the surface surrounding its outer circumference, the destaticizing device that destaticizes the surface of the photosensitive body by irradiating it with destaticizing light based on an instruction of the control part, and the cleaning sequence, which is executed by the control part, means that the photosensitive body rotates once or multiple times under a state where the photosensitive body is irradiated with the destaticizing light and the charging voltage is applied to the charging part.

5. The image forming apparatus according to claim 4, wherein when executing the cleaning sequence, the control part applies a voltage to the development part wherein the voltage acts so as to prevent the carried developer from moving to the photosensitive body.

6. The image forming apparatus according to claim 4, wherein when executing the light exposure detection process, the control part continues to apply the charging voltage, the development voltage, and the transfer voltage while the photosensitive body makes at least two rotations, and after the sensor detects the developer image of predetermined amount at least twice with an interval of a circumferential length of the photosensitive body a moving direction of the transfer-target member, the control part executes the cleaning sequence.

7. The image forming apparatus according to claim 4, wherein the image forming unit and the transfer part, which corresponds to the image forming unit, make an image forming pair, and the image forming apparatus is composed with a plurality of the image forming pairs that are disposed along a moving direction of the transfer-target member such that the image forming apparatus includes a plurality of the image forming units and a plurality of the transfer parts.

8. The image forming apparatus according to claim 7, wherein the control part simultaneously applies the charging voltage, the development voltage, and the transfer voltage to the plurality of image forming pairs, and if the developer image of predetermined amount is not detected by the sensor, the control part does not execute the cleaning sequence.

9. The image forming apparatus according to claim 7, wherein the control part sequentially executes the light exposure detection process to the plurality of image forming pairs, and the control part simultaneously executes the cleaning sequence to one of the image forming pairs in which the developer image of predetermined amount is detected.

10. The image forming apparatus according to claim 7, wherein the control part sequentially executes the light exposure detection process to the plurality of image forming pairs, and soon after the developer image of predetermined amount is detected in any of the image forming units, the control part executes the cleaning sequence to all the image forming units.

11. The image forming apparatus according to claim 10, wherein when executing the light exposure detection process sequentially to the plurality of image forming pairs, the control part starts from one of the image forming units that has the most frequently-used photosensitive body.

12. The image forming apparatus according to claim 7, wherein the control part simultaneously executes the light exposure detection process to all the image forming pairs.

13. The image forming apparatus according to claim 7, wherein the control part groups the plurality of image forming pairs into two series that are odd-numbered series and even-numbered series, and the control part simultaneously executes the light exposure detection process to the image forming units in each group.

14. The image forming apparatus according to claim 7, further comprising:

a separation part that is controlled by the control part, wherein the plurality of image forming units are configured to be individually separable from the transfer-target member by the separation part, and the image forming units except for one of the image forming unit to which the light exposure detection process is to be executed are positioned in standby positions that are separated from the transfer-target member.

15. The image forming apparatus according to claim 2, wherein after executing the cleaning sequence, the control part executes the light exposure detection process, and if the developer image of predetermined amount is detected by the sensor again, the control part prints the developer image of predetermined amount on a recording medium.

16. The image forming apparatus according to claim 2, wherein after executing the cleaning sequence, the control part executes the light exposure detection process, and if the developer image of predetermined amount is detected, the control part eventually stops a light-exposed part of the photosensitive body at a transfer position.

* * * * *